US005139308A

United States Patent [19]

Ziman

[11] Patent Number: 5,139,308

[45] Date of Patent: Aug. 18, 1992

[54] CHAIR WITH STORAGE BAG AND CARRYING STRAPS

[76] Inventor: Malcolm G. Ziman, 5581 La Cuenta, San Diego, Calif. 92124

[21] Appl. No.: 740,044

[22] Filed: Aug. 2, 1991

[51] Int. Cl.[5] ..... A47C 7/62

[52] U.S. Cl. ..... 297/191; 297/31; 297/16; 297/129

[58] Field of Search ..... 297/31, 39, 129, 188, 297/191, 194, 16, 27; 224/42.46 R, 155, 901

[56] References Cited

U.S. PATENT DOCUMENTS

| | | | |
|---|---|---|---|
| 4,240,480 | 12/1980 | Strobel | 150/3 |
| 4,300,707 | 11/1981 | Ijaer | 297/129 X |
| 4,487,345 | 12/1984 | Pierce et al. | 297/191 X |
| 4,514,009 | 4/1985 | Vanderminden et al. | 297/27 |
| 4,676,548 | 6/1987 | Bradbury | 297/191 X |
| 4,687,248 | 8/1987 | Ross et al. | 297/17 X |
| 4,687,249 | 8/1987 | Mills | 297/31 X |
| 4,720,029 | 1/1988 | Varanakis | 224/155 |
| 5,016,792 | 5/1991 | Jay | 297/129 X |
| 5,040,711 | 8/1991 | Niederhauser et al. | 224/42.46 R |

FOREIGN PATENT DOCUMENTS

| | | | |
|---|---|---|---|
| 1194851 | 6/1970 | United Kingdom | 224/155 |

*Primary Examiner*—Peter R. Brown
*Attorney, Agent, or Firm*—Hawes & Fischer

[57] ABSTRACT

The chair is formed with a base and a folding back, both made of strength members, such as metal tubing. Seat fabric is attached to the base, and back fabric is attached to the back. A storage bag is detachably attached to the back and, when the chair is in the folded position, the bag can swing over the seat and detachably attach to the seat to hold the chair in the folded position. Shoulder carrying straps are attached to the back for convenient carrying of the chair in the folded position.

17 Claims, 6 Drawing Sheets

CHAIR WITH STORAGE BAG AND CARRYING STRAPS

BACKGROUND OF THE INVENTION

1. Field of the Invention

This invention is directed to a folding chair which includes a storage bag which detachably engages the chair to hold it in the folded position and also includes shoulder carrying straps for carrying the chair and storage bag.

2. Background Art

Folding chairs provide the convenience of a chair together with compactness of storage. In the folded position, such folding chairs occupy less space than a nonfolding chair. Folding chairs have seats and backs and are often made of tubular framework. The tubular framework has supporting fabric, straps or cords attached thereto to provide comfortable resiliency while the user is sitting thereon and leaning against the back. An additional benefit of such folding chairs is that they are lightweight. Thus, they were more easily carried to a place where they are to be used. However, when the distance between storage and use is a long way, as between a parked car and a beach, carrying such a folding chair by hand becomes inconvenient. Furthermore, when going to and from such destinations, quite often other goods are also desired. These other goods may be snack items, beverages in containers, or entertainment devices such as portable radios, magazines or books. Carrying these additional materials as well as the chair becomes inconvenient. Furthermore, these additional materials must be conveniently managed after the user has reached his destination, unfolds his chair, and utilizes his materials. Therefore, there is a need for a chair which can be ccnveniently carried from place to place and carry therewith additional materials.

SUMMARY OF THE INVENTION

In order to aid in the understanding of this invention, it can be stated in essentially summary form that it is directed to a folding chair with a storage bag and carrying straps. The chair has a base together with a folding back with flexible supporting structure thereon for comfortable sitting. A storage bag is attached to the chair, and shoulder carrying straps are attached to the chair for conveniently carrying the folding chair and the storage bag to and from a place of use.

DESCRIPTION OF THE PREFERRED EMBODIMENT

Figure 1:
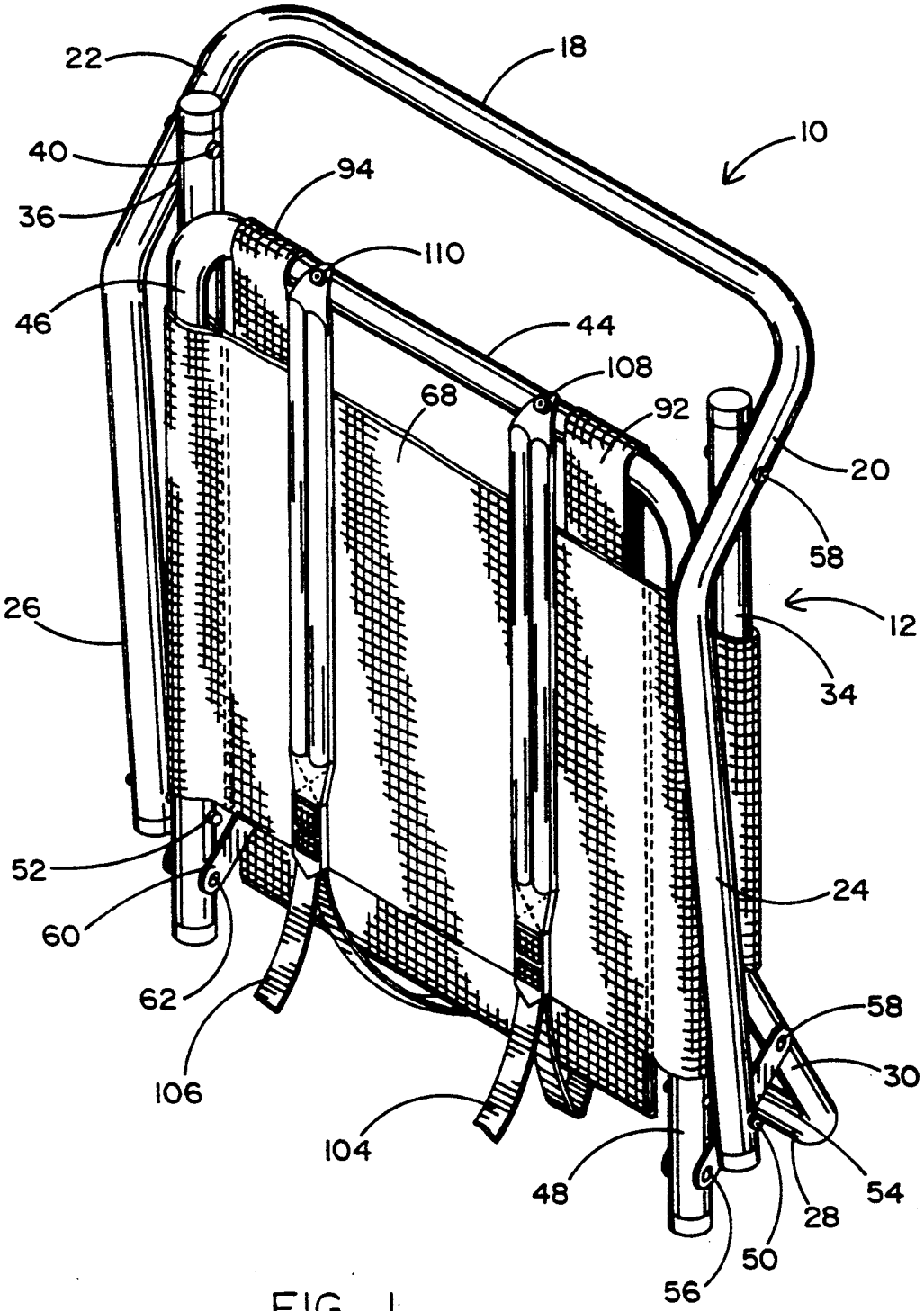
FIG. 1 is a perspective view of the folding chair with storage bag and carrying straps in accordance with this invention shown standing on its back edge.
Figure 2:
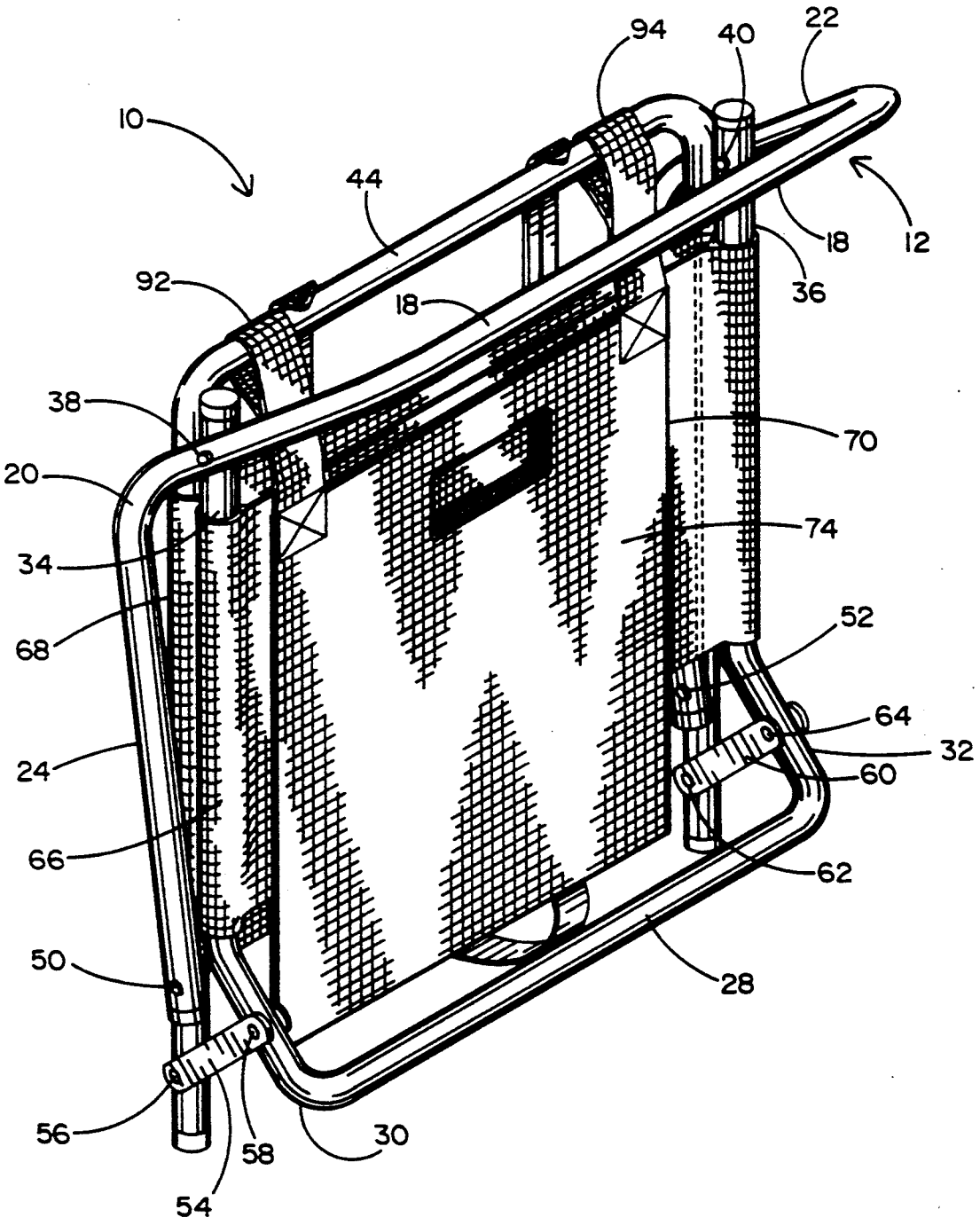
FIG. 2 is a similar view showing the underside thereof.
Figure 3:
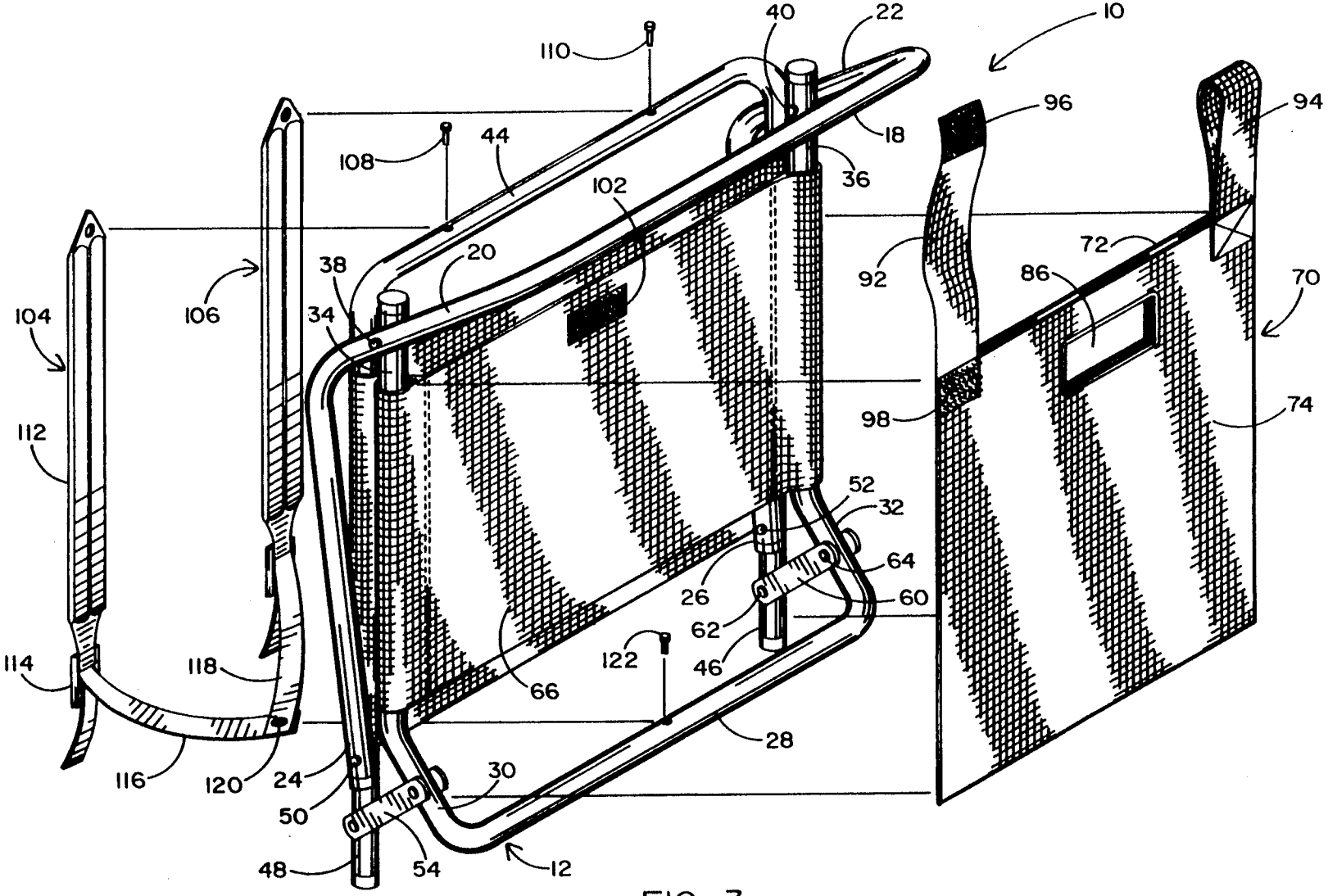
FIG. 3 is a view similar to FIG. 2 showing the components of the folding chair with storage bag and carrying straps of this invention in exploded position.
Figure 4:
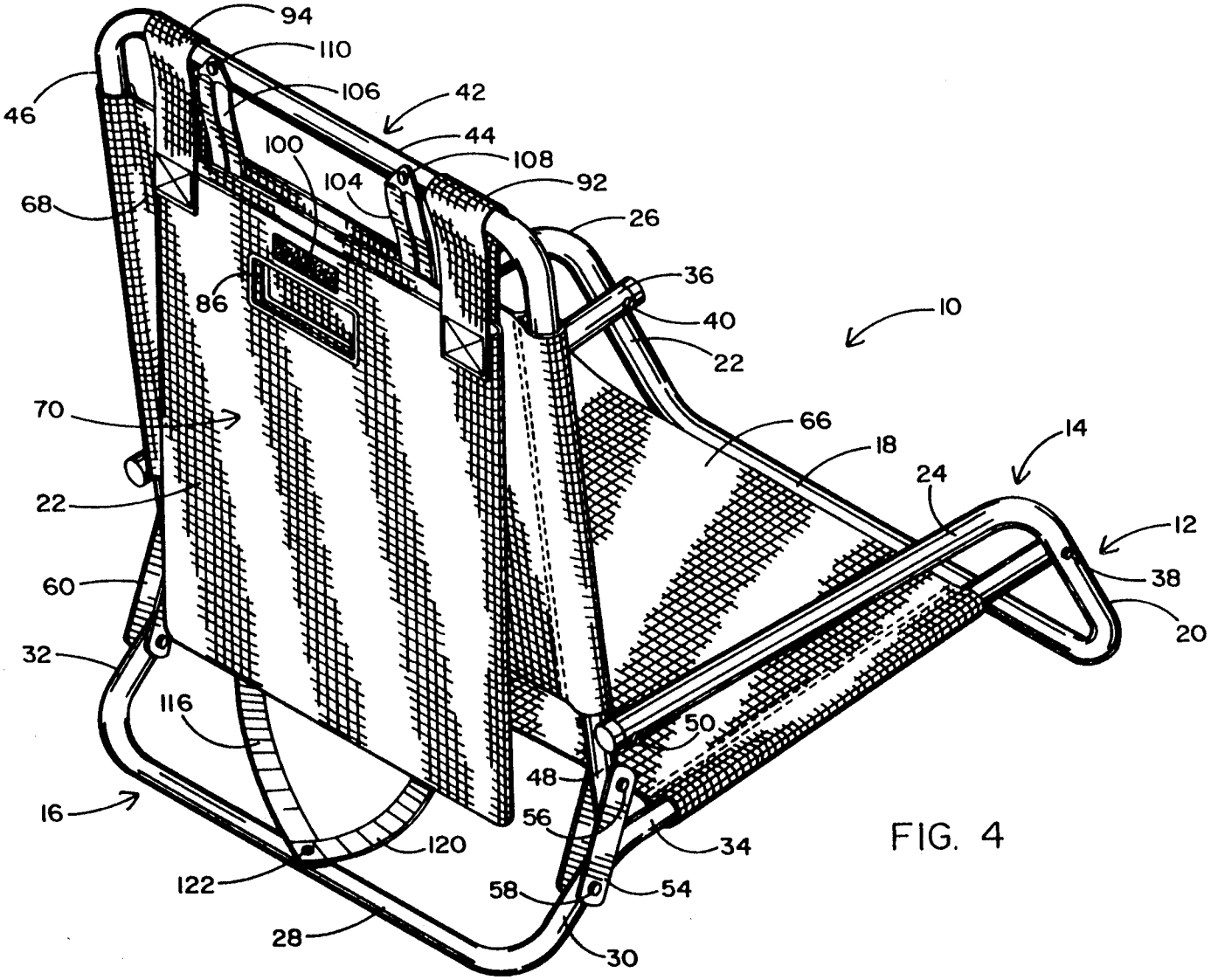
FIG. 4 is a perspective view of the folding chair in the unfolded position and showing the attached storage bag wherein it is dependent from the top rail of the chair back.
Figure 5:
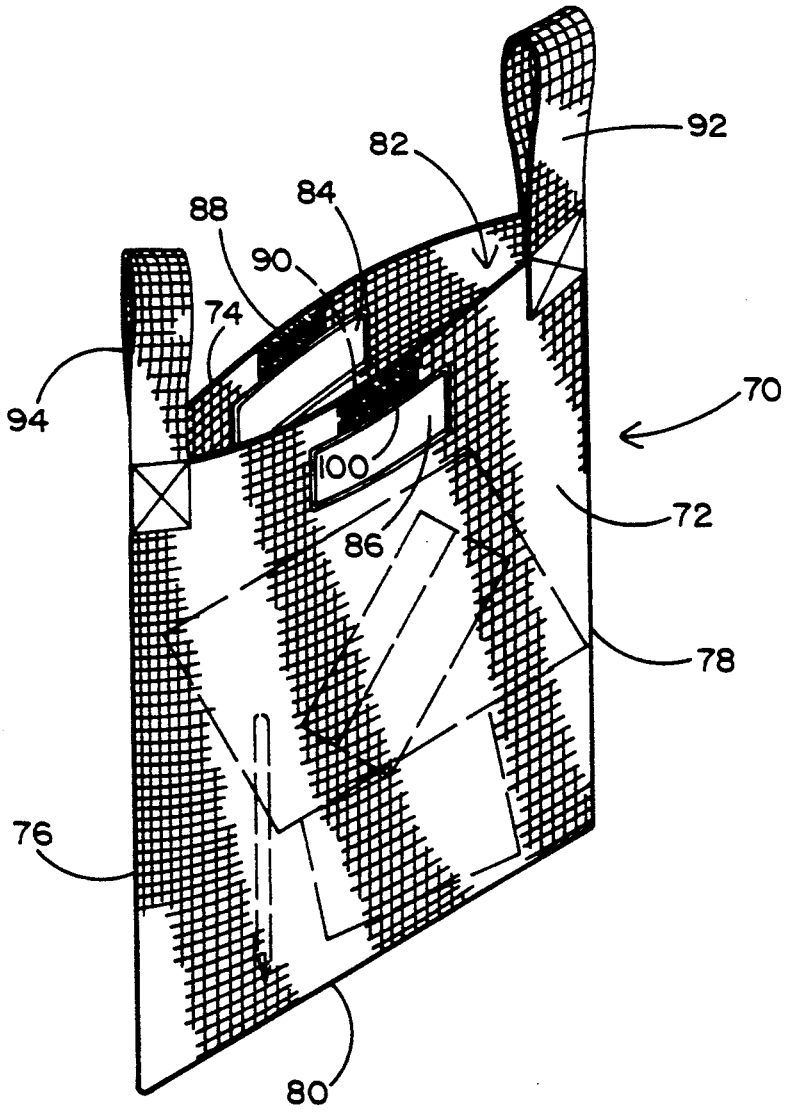
FIG. 5 is a perspective view of the storage bag detached from the folding chair.

The folding chair with storage bag and carrying straps in accordance with this invention is generally indicated at 10 in FIGS. 1, 2, 3, 4 and 6. The base 12 of the chair 10 has front and rear frame members 14 and 16. Each is U-shaped and made out of strength members. Front frame member 14 has a foot 18 attached to right and left legs 20 and 22, which in turn respectively attach to right and left arms 24 and 26. Right and left designations are the directions, as seen by the person seated in the chair. Rear frame member 16 is also U-shaped with the arms of the U separated slightly less than the arms of frame member 14. The legs and arms are joined by an appropriate angle so that, when the foot is on the ground in the erect position, the arms are substantially horizontal. Rear frame member 16 has rear foot 28 with right and left legs 30 and 32 attached thereto. Right and left arms 34 and 36 extend forward from the right and left legs. Each of the front and rear frame members 14 and 16 is preferably a single integral length and may be made of metal tubing, such as aluminum tube. The distance between the arms 34 and 36 is sufficiently less than the distance between the arms 24 and 26 so that the arms 34 and 36 lie inside of legs 20 and 22, as seen in FIG. 4. Right arm 34 is pivoted to right leg 20 by means of right pivot pin 38, and left arm 36 is pivoted to left leg 22 by means of left pivot pin 40.

Back 42 is a similar U-shaped chair member .It has a top rail 44 and left and right side rails 46 and 48. Like the bends of the legs with respect to the feet, the back side rails are each positioned at a right angle with respect to the top rail. The spacing of the side rails is the same as the right and left arms 34 and 36 so that the side rails lie inside of the right and left arms 24 and 26. Right and left pivot pins 50 and 52 pivot the right and left side rails 48 and 46 to the rear end of right and left arms 24 and 26. In the chair-erected position, the right and left side rails 48 and 46 rest on top of the right and left arms 34 and 36 close to where the arms join the legs 30 and 32, see FIG. 4. Right link 54 is pivotally attached adjacent the lower end of right side rail 48 by means of pivot pin 56, and the link is also attached to the right leg 30 by means of pivot pin 58. Similarly, left link 60 is pivoted to left side rail 46 by means of pivot pin 62 and to left leg 32 by means of pivot pin 64, see FIG. 3. The links are preferably installed in pairs, as shown, to balance the loads. All pivot pins are preferably rivets to securely attach the three chair parts together in a pivotal relationship. The geometry is such that, when in the erected position shown in FIG. 4, a chair configuration is formed with a slightly downwardly, rearwardly sloping seat and a slightly backwardly, upwardly sloping back. To provide a surface upon which the person can sit and lean, seating surface 66 and back rest surface 68 are provided. These surfaces may each be made of a single piece of fabric with a sewn-in pocket on each end. The pockets of the seating surface are respectively engaged on right and left arms 34 and 36. The pockets on the back rest surface are respectively engaged in right and left side rails 48 and 46, as seen in FIG. 4. The fabric can be a fine woven synthetic polymer material, such as nylon, or may be made of a natural material, such as cotton canvas. Furthermore, instead of being made of a single piece, the seating surface 66 may be made of a plurality of straps extending between the arms, and the back rest surface may be made of a plurality of straps extending between the side rails. Any conventional resilient seating surface can be employed.

The storage bag associated with the chair 10 is generally indicated at 70 in FIGS. 2, 3, 4 and 5. The storage bag 70 is formed of a front wall 72 and a rear wall 74. The walls are joined together at left edge 76, right end 78 and bottom 80, see FIG. 5. The front and rear walls are preferably of fabric, or other flexible material, but may be of the same material as the seating surface and back rest surface when they are made of fabric. The front and rear walls are joined together at the left edge, right edge and bottom to form a pocket or envelope which is open at the top and which is otherwise closed. This envelope is generally indicated at 82 in FIG. 5. Openings 84 and 86 are provided adjacent the top edge of the storage bag walls to provide a hand hold for carrying the storage bag. Above the openings 84 and 86, portions 88 and 90 of a detachable hook-and-loop fastener are provided. When these portions are closed together, the pocket 82 is also closed at the top to retain articles within the pocket of the storage bag. These articles may be any of those previously described, such as snack or beverage items, or entertainment items such as magazines, books or audio equipment. Such can be conveniently stored in the storage bag 70. In order to maintain the storage bag and the materials supplied therein in a convenient location, the storage bag is provided with right and left hanging straps 92 and 94. These hanging straps are sewn to the front wall 72 and are detachably attached to the rear wall 74 by means of hook-and-loop fasteners having fastener sections 96 and 98, as seen in FIG. 3. It must be noted that the front wall 72 faces rearwardly of the chair when erected, as shown in FIG. 4. Wall 72 is designated the front wall because it faces the user as he stands behind the chair to place materials within the storage bag or remove them therefrom. When the chair is folded, the storage bag is flipped over the top bar 44 to lie under the seating surface 66, as shown in FIGS. 2 and 3. Additionally, hock-and-loop fastener portions 100 and 102 are respectively secured on the front of the storage bag 70 above the handle opening 86, see FIGS. 4 and 5, and underneath the forward edge of the seating surface 66, see FIG. 3. When the chair is folded and the storage bag 70 is flipped over the top rail 44 to lie against the underside of the seating surface, these hook-and-loop fastener portions are directly adjacent each other to attach to one other. When attached, they secure the top rail 44 to the underside of the seating surface to hold the folding chair 10 in the closed position, as seen in FIG. 2. Now, the chair is closed and the storage bag 70 and chair 10 are secured together for ease of conveyance.

Figure 6:
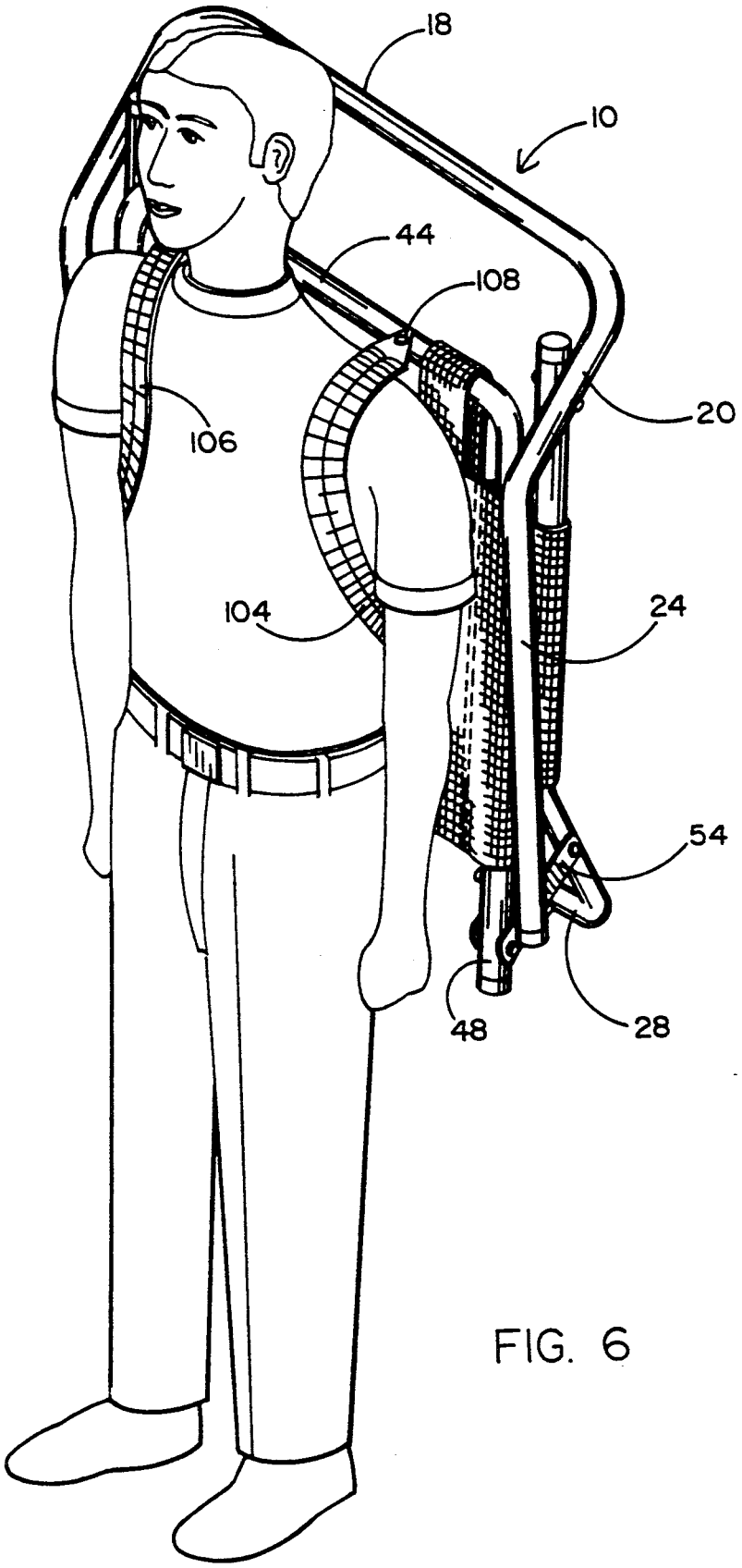
FIG. 6 is a perspective view of the folding chair with storage bag and carrying straps in accordance with this invention shown in the folded position and being carried by a person on his back.

To aid in ease of transportation, left and right shoulder straps 104 and 106 are attached to the folding chair 10. The shoulder straps are identified in accordance with the shoulder of the person carrying the chair, see FIG. 6. The upper end of each shoulder strap has a grommeted opening. Rivets 108 and 110 secure the upper end of the shoulder straps by engagement through openings in the top rail 44 of the back, see FIGS. 1, 3 and 4. Each of the shoulder straps has a padded shoulder-engaging portion 112, see FIG. 3. At the lower end of the shoulder-engaging portion is an adjustment buckle, with the buckle 114 indicated on portion 112. Bottom straps 116 and 118 extend through the buckles so as to provide length adjustment. The lower end of the bottom straps has a common grommet 120 therethrough which is secured to the rear foot 28 by means of rivet 122. It is to be noted that the geometry of the folding chair frame members is such that the side rails of the back are beside the shoulders of the carrying person, and the top rail 44 is above his shoulders. There are no other frame members which come close to the person's back. Thus, the folding chair with its storage bag is easy to carry. When unfolded, as seen in FIG. 4, the carrying straps hang loose behind the back frame and fabric. When the storage bag is flipped over the back prior to opening of the chair to the position of FIG. 4, the carrying straps are out of the way and are positioned between the storage bag and the back of the chair. From the use position shown in FIG. 4, the chair is easily moved into the transport position by folding up the front frame member while maintaining the back in the generally upright position and, thereafter, swinging the storage bag over the top rail 44 so that the storage bag attaches under the seat to hold the folding chair in the folded position. The chair is now ready for transport and can be carried on the shoulders, as indicated in FIG. 6.

This invention has been described in its preferred embodiment, and it is clear that it is susceptible to numerous modifications, modes and embodiments within the ability of those skilled in the art and without the exercise of the inventive faculty. Accordingly, the scope of this invention is defined by the scope of the following claims.

I claim:

1. A chair with a storage bag comprising:

a base frame having at least opposing side frame member sand a plurality of leg members interconnected with said side frame members;

a seat carried by the side frame members of said base frame to support a sedentary person, said seat having a top side and an underside;

a back frame having opposing side rails and a top rail extending therebetween;

a back rest extending between the side rails of said back frame;

means for pivotally connecting said back frame to said base frame so that said back frame rotates from a folded position, where said back rest faces the top side of said seat in substantially parallel alignment with said seat, to an unfolded position, where said back rest and said seat are aligned substantially perpendicular to one another;

a storage bag pivotally attached to the top rail of said back frame to depend therefrom, said storage bag facing said back rest in parallel alignment therewith when said back frame is in said unfolded position relative to said base frame, and said storage bag rotated around said top rail for facing the underside of said seat in parallel alignment therewith when said back frame is in said folded position;

first fastening means located on said storage bag; and second fastening means located at the underside of said seat, said first and second fastening means being mated together to attach said storage bag to the underside of said seat and thereby retain said back frame in said folded position relative to said base frame.

2. The chair of claim 1 wherein said storage bag has sides, bottom and top and said storage bag is closed on its dies and bottom and is open at its top, together with closure means adjacent said top for releasably closing said open top of said storage bag.

3. The chair of claim 2 wherein said storage bag has first and second straps thereon, each of said straps having a first end fixed to said storage bag adjacent its open top and a second end releasably attached to said storage bag adjacent its open top, said first and second straps embracing the top rail of said back frame for pivotally attaching said storage bag thereto.

4. The chair of claim 3 wherein each of the second ends of said straps has a portion of a hook-and-loop fastener thereon and said storage bag has a complementary portion of a hook-and-loop fastener thereon adjacent said open top so that said straps are releasably attached to said storage bag by said hook-and-loop fastener portions.

5. The chair of claim 1 further including first and second shoulder straps attached to said chair for carrying said chair when said back rest is in its folded position.

6. The chair of claim 5 wherein first ends of said first and second shoulder straps are attached to said top rail of said back frame and second ends of said straps are attached to one of said plurality of leg members of said base frame.

7. The chair of claim 6 wherein said shoulder straps are adjustable.

8. The chair of claim 5 wherein said shoulder straps are positioned between said storage bag and said back rest when said back frame is in said unfolded position relative to said base frame.

9. A folding chair comprising:

a base frame having at least opposing side frame members and a plurality of leg members interconnected with said side frame members;

a seat carried by the side frame members of said base frame to support a sedentary person, said seat having a top side and an underside;

a back frame having opposing side rails and a top rail extending therebetween;

a back rest extending between the side rails of said back frame below the top rail thereof;

means for pivotally connecting said back frame to said base frame so that said back frame rotates from a folded position, where said back rest faces the top side of said seat in substantially parallel alignment with said seat, to an unfolded position, where said back rest and said seat are aligned substantially perpendicular to one another;

first and second shoulder straps attached to said back frame for carrying said chair when said back frame is in said folded position relative to said base frame, said first and second shoulder straps having first ends attached to the top rail of said back frame and second ends attached to said base frame;

a storage bag pivotally attached to the top rail of said back frame to depend therefrom, said storage bag facing said back rest in parallel alignment therewith when said back frame is in said unfolded position relative to said base frame, and said storage bag rotated around said top rail for facing the underside of said seat in parallel alignment with said seat when said back frame is in said folded position; and means for attaching said storage bag to the underside of said seat to thereby retain said back frame in the folded position relative to said base frame.

10. The chair of claim 9 wherein the first ends of said first and second shoulder straps are secured to said top rail and are spaced apart from each other at said top rail so as to be received over the shoulders of the carrying person, and the second ends of said first and second shoulder straps are attached to one of the plurality of leg members of said base frame.

11. The chair of claim 9 wherein said shoulder straps are adjustable so as to conveniently fit carrying persons of different size.

12. The chair of claim 9 wherein said storage bag has a open top and means for releasably closing said open top of said storage bag so that said storage bag can be used for carrying and storing even when said back frame is in its folded position and said chair is being carried by said shoulder straps.

13. The chair of claim 9 wherein said means for attaching said storage bag to said seat comprises first fastening means located on said storage bag and second fastening means located at the underside of said seat, said first and second fastening means being mated together to attach said storage bag to the underside of said seat and thereby retain said back frame in said folded position relative to said base frame.

14. A chair comprising:

a base frame having at least two opposing side frame members and leg members interconnected with said side frame members;

a seat carried by the side frame members of said base frame to support a sedentary person, said seat having a top side and an underside;

a back frame having at least a pair of opposing side rails;

a back rest extending between the side rails of said back frame;

means for pivotally connecting said back frame to said base frame so that said back frame rotates from a folded position, where said back rest faces the top side of said seat in substantially parallel alignment with said seat, to an unfolded position, where said back rest and said seat are aligned substantially perpendicular to one another;

a storage bag attached to said back frame and facing the underside of said seat in parallel alignment with said seat when said back frame is in said folded position relative to said base frame;

first fastening means located on said storage bag and second fastening means located on the underside of said seat, said first and second fastening means being mated together to attach said storage bag to the underside of said seat and thereby retain said back frame in said folded position; and first and second shoulder straps extending between said base frame and said back frame for carrying said chair when said back frame is in said folded position.

15. The chair of claim 14 where said back frame also h as a top rail extending between said side rails, said shoulder straps extending from said back frame at said top rail thereof.

16. The chair of claim 15 where said storage bag is pivotally attached to said back frame at the top rail thereof, said storage bag facing said back rest in parallel alignment therewith when said back frame is in said unfolded position relative to said base frame, and said storage bag rotated around said top rail for facing the underside of said seat in parallel alignment therewith when said back frame is in said folded position.

17. The chair of claim 14 where said seat, said back rest and said storage bag are all made from the same material.

* * * * *